US006086693A

United States Patent [19]

Mendenhall et al.

[11] Patent Number: 6,086,693

[45] Date of Patent: Jul. 11, 2000

[54] LOW PARTICULATE IGNITER COMPOSITION FOR A GAS GENERANT

[75] Inventors: Ivan V. Mendenhall, Providence; Robert D. Taylor, Hyrum; Reed J. Blau, Richmond, all of Utah; Gary K. Lund, Malad, Id.; Daniel W. Doll, North Ogden, Utah

[73] Assignees: Autoliv ASP, Inc., Ogden, Utah; Cordant Technologies, Inc.

[21] Appl. No.: 09/243,557

[22] Filed: Feb. 2, 1999

[51] Int. Cl.[7] ..... C06B 33/04; C06B 31/02

[52] U.S. Cl. ..... 149/43; 149/61

[58] Field of Search ..... 149/22, 61, 62, 149/63, 66, 108.6, 109.6, 43

[56] References Cited

U.S. PATENT DOCUMENTS

| | | | |
|---|---|---|---|
| H169 | 12/1986 | Mackenzie et al. | 149/19.3 |
| H285 | 6/1987 | Downs et al. | 149/79 |
| 2,033,966 | 3/1936 | Wiley . | |
| 2,700,603 | 1/1955 | Hart et al. . | |
| 2,796,339 | 6/1957 | Jackson . | |
| 3,317,362 | 5/1967 | Doris, Jr. et al. | 149/19 |
| 3,350,245 | 10/1967 | Dickinson | 149/19 |
| 3,454,437 | 7/1969 | Yamazaki et al. | 149/21 |
| 3,613,758 | 10/1971 | Furth et al. | 149/15 |
| 3,634,153 | 1/1972 | Perkins et al. | 149/19 |
| 3,682,727 | 8/1972 | Heinzelmann et al. | 149/19 |
| 3,769,106 | 10/1973 | Hyer | 149/18 |
| 4,858,951 | 8/1989 | Lenzen | 280/741 |
| 5,074,938 | 12/1991 | Chi | 149/21 |
| 5,271,778 | 12/1993 | Bradford et al. | 149/19.5 |
| 5,542,688 | 8/1996 | Scheffee | 280/741 |
| 5,672,843 | 9/1997 | Evans et al. | 102/289 |
| 5,756,929 | 5/1998 | Lundstrom et al. | 149/22 |
| 5,889,161 | 3/1999 | Bottaro et al. | 534/551 |
| 5,959,242 | 9/1999 | Knowlton et al. | 149/38 |

*Primary Examiner*—Charles T. Jordan
*Assistant Examiner*—Aileen J. Baker
*Attorney, Agent, or Firm*—Pauley Petersen Kinne & Fejer

[57] ABSTRACT

Igniter compositions and methods of processing are provided which produce or result in relatively little particulate material, as compared to typical igniter compositions used in association with vehicle occupant restraint airbag cushions.

21 Claims, 1 Drawing Sheet

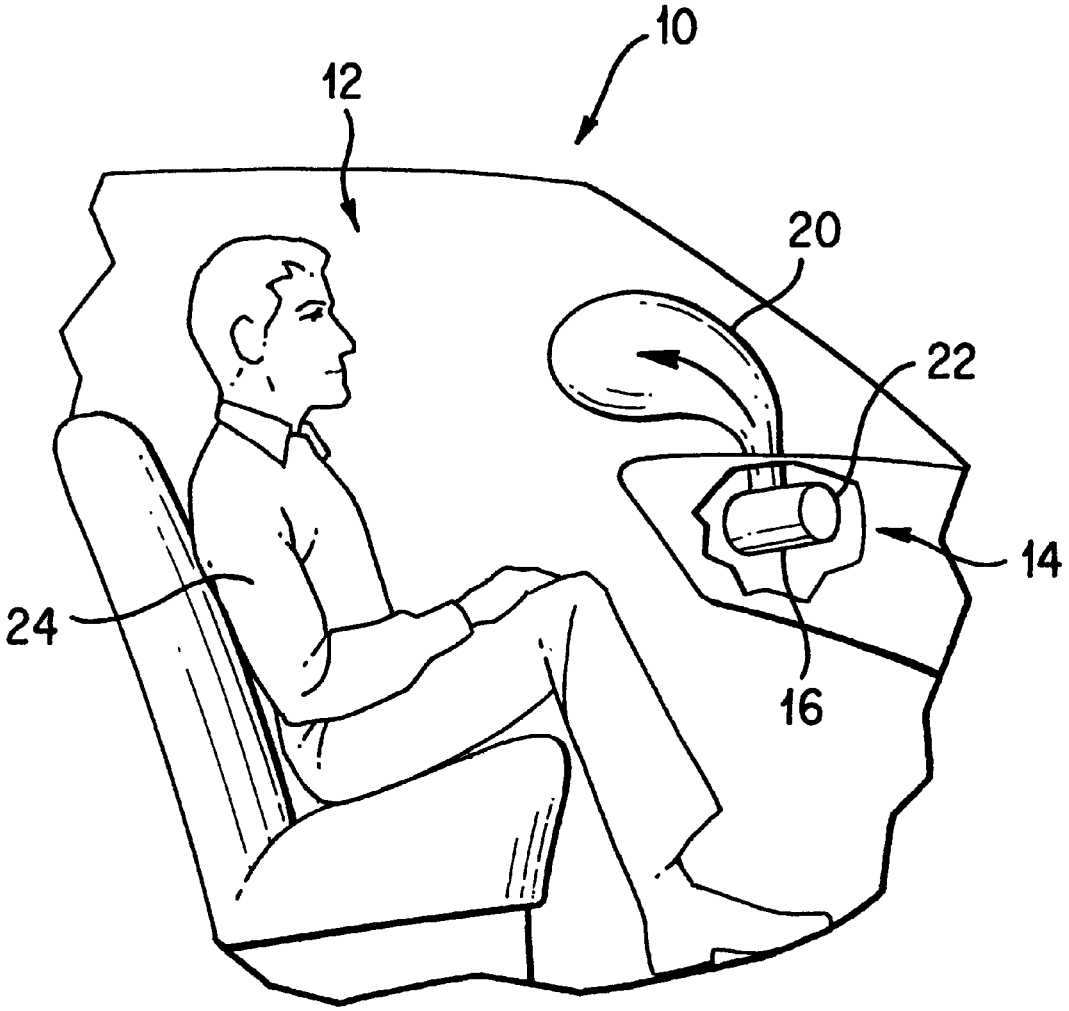
FIGURE

LOW PARTICULATE IGNITER COMPOSITION FOR A GAS GENERANT

BACKGROUND OF THE INVENTION

This invention relates generally to the ignition of a gas generant such as used for the inflation of inflatable devices such as airbag cushions used in inflatable restraint systems for vehicle occupants. In particular, the invention relates to such an ignition material which, upon combustion, produces a relatively small amount of particulate as compared to igniter compositions such as typically used in association with vehicle occupant restraint airbag cushions.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Such systems typically also include one or more crash sensors mounted on or to the frame or body of the vehicle to detect sudden decelerations of the vehicle and to electronically trigger activation of the system. Upon actuation of the system, the cushion begins to be inflated in a matter of no more than a few milliseconds with gas produced or supplied by a device commonly referred to as an "inflator."

Many types of inflator devices have been disclosed in the art for the inflating of one or more inflatable restraint system airbag cushions. Inflator devices which form or produce inflation gas via the combustion of a gas generating material are well known. It is also known that certain of such inflator devices may use such generated gas to supplement stored and pressurized gas by the addition of high temperature combustion products, including additional gas products, produced by the burning of the gas generating material to a supply of the stored, pressurized gas. In some cases, the combustion products produced by the burning of a gas generating material may be the sole or substantially the sole source for the inflation gas issuing forth from a particular inflator device.

It is common that inflator devices include an initiator, such as a squib, and an igniter. In practice, upon receipt of an appropriate triggering signal from a crash or other selected deceleration sensor, the initiator activates causing the rapid combustion of the igniter material, which, in turn, ignites the gas generant.

The reduction in either or both the amount and concentration of particulate material that may issue forth from an inflator device upon the actuation thereof has been one focus of continuing improvement efforts. While such efforts have largely focused on gas generant composition formulations, igniter compositions may also significantly contribute to the particulate output of at least certain inflator devices.

A common or standard igniter formulation used for airbag inflators is composed of about 15 to about 30 weight percent (typically about 25 weight percent) boron and about 70 to about 85 weight percent (typically about 75 weight percent) potassium nitrate. In the art, this standard igniter formulation is commonly referred to as "$BKNO_3$." While such an igniter composition has generally been useful and effective in such inflatable restraint system applications, the resulting combustion products typically include a significant portion which, though gaseous at the combustion temperatures and pressures typically occurring within the inflator device, condense and solidify into particulate at exhaust conditions, such as upon being exhausted into an associated airbag cushion.

As will be appreciated, the presence or occurrence of significant amounts of such condensible gaseous materials in inflatable restraint system airbag cushion inflation gases can be undesirable for various and numerous reasons. For example, such condensible gases are normally not easily removable or separable from the inflation gases via the application of simple filtration means. As will be appreciated, the presence of solid particulate material within inflatable restraint system airbag cushion and such as may subsequently be vented or passed to within the occupant compartment of the associated vehicle is generally undesired. For example, though such particulate material is normally variously sized, such particulate material typically includes a large amount of particulate within the respirable range for humans. Thus, the passage of such gas-borne particulate material into the passenger compartment of the corresponding vehicle, such as via conventional airbag venting, can result in undesired respiration of such particulate material by the driver and/or other vehicle passengers which in turn can cause consequent respiratory problems. Also, such particulate can easily become dispersed and airborne so as to appear to be smoke and such as may create a false impression that there is a fire in or about the vehicle.

There is a continuing need and demand for improved igniter materials for inflator device gas generating materials. In particular, there is a need and a demand for such an igniter material which may desirably be improved in one or more aspects such as safety, simplicity, effectiveness, economy and reliability. Further, in view of the above, there is a need and a demand for an igniter formulation such as may further reduce either or both the amount or concentration of particulate material that may issue forth from associated inflator devices upon the actuation thereof. Also, boron can be a relatively expensive component of common igniter formulations such as described above. As a result, there is a need and a demand for igniter formulations which reduce, minimize or possibly avoid the need for such relatively costly igniter composition components.

In addition, previous efforts at water processing of compositions containing magnesium or alloy combinations thereof have typically run into difficulties such as associated with the reaction of such materials with water. While solvent processing techniques are available, such processing typically requires or necessitates various additional costly processing steps in association with the environmentally desirable recovery or recycle of such solvent materials. Thus, there has been a need and demand for an improved method for water processing an igniter composition for a gas generant material, and which composition contains magnesium or an alloy combination thereof.

SUMMARY OF THE INVENTION

A general object of the invention is to provide an improved igniter composition and method of processing.

A more specific objective of the invention is to overcome one or more of the problems described above.

The general object of the invention can be attained, at least in part, through an igniter composition which includes:

- a about 50 to about 75 composition weight percent of an oxidizer comprising strontium nitrate;
- about 0.5 to about 35 composition weight percent of an Al/Mg alloy fuel component; and
- about 1 to about 20 composition weight percent of a gas-producing fuel component.

The prior art fails to provide an igniter composition, such as for a gas generant material and such as used in association vehicle occupant restraint airbag cushions, which composition minimizes or reduces to as great as desired extent the resulting amount particulate material. Further, the prior art fails to provide as effective as desired method for water processing an igniter composition for a gas generant material, and which composition contains magnesium or an alloy combination thereof.

The invention further comprehends a reduced particulate igniter composition for a gas generant material. The reduced particulate igniter composition includes about 50 to about 75 composition weight percent of an oxidizer component, about 0.5 to about 35 composition weight percent of the Al/Mg alloy fuel component, and about 1 to about 20 composition weight percent of a gas-producing water-soluble organic polymer binder fuel component. More specifically, the oxidizer component includes strontium nitrate and potassium nitrate, wherein no more than about 50 mass percent of the oxidizer is potassium nitrate and the Al/Mg alloy fuel component has an Al content of about 50 to about 80 percent and a Mg content of about 20 to about 50 percent. The reduced particulate igniter composition has a combustion flame temperature of at least about 2750 K and, upon combustion, the igniter composition produces combustion products including condensible combustion products wherein no more than about 50 mass percent of the condensible combustion products melt at a temperature of less than about 2750 K. In certain preferred embodiments, the subject igniter composition produces combustion products including condensible combustion products wherein no more than about 25 mass percent of the condensible combustion products melt at a temperature of less than about 2750 K.

The invention still further comprehends a method of processing an igniter composition for a gas generant material. In accordance with one preferred embodiment of the invention, such method involves the step of admixing about 10 to about 20 weight percent water to an igniter composition precursor mix containing, on a water free basis, about 50 to about 75 percent of an oxidizer comprising strontium nitrate, about 0.5 to about 35 percent of an Al/Mg alloy fuel component and about 1 to about 20 percent of a gas-producing fuel component comprising a water-soluble organic polymer binder to form a moisture-containing igniter precursor mass. The moisture-containing igniter precursor mass is then sized and dried to form a granular igniter material of selected particle size.

Other objects and advantages will be apparent to those skilled in the art from the following detailed description taken in conjunction with the appended claims and drawing.

BRIEF DESCRIPTION OF THE DRAWING

The FIGURE is a simplified schematic, partially broken away, view illustrating the deployment of an airbag cushion from an airbag module assembly within a vehicle interior, in accordance with one embodiment of the invention.

DETAILED DESCRIPTION OF THE INVENTION

The present invention provides an igniter composition such as for a gas generant material used in the inflation of inflatable devices such as vehicle occupant restraint airbag cushions. Such combustible igniter compositions typically include an oxidizer component comprising strontium nitrate, an Al/Mg alloy fuel component, and a gas-producing fuel component. In particular, igniter compositions in accordance with the invention have been found to produce a relatively small or little amount of particulate such as compared to typical igniter compositions, such as $BKNO_3$.

In accordance with certain preferred embodiments of the invention, about 50 to about 75 percent of the subject igniter compositions generally constitutes such oxidizer component. The major oxidizer component is desirably selected for producing an easily filterable combustion product slag. In accordance with one preferred embodiment of the invention, at least about 50 wt % up to 100 wt % of the oxidizer component of the subject igniter compositions comprises strontium nitrate. Strontium nitrate has been found to desirably produce condensible combustion products, such as strontium oxide, which have a relatively high-melting point. As will be appreciated, such high-melting temperature condensible combustion products can generally more easily be filtered or otherwise removed from the inflation gases produced or formed by an associated inflator device, as compared to igniter compositions such as standard $BKNO_3$ which produce or form low-melting temperature combustion products in relatively greater proportion.

The oxidizer component of the subject igniter compositions may additionally include up to about 50 wt % of an alkali metal nitrate such as potassium nitrate. The igniter composition inclusion of an alkali metal nitrate such as potassium nitrate may be desired such as to increase the ignitability of the resulting igniter compositions. It will be understood, however, that as the inclusion of such alkali metal nitrate may, upon combustion, result in increased formation of combustion products which pass through filtering devices as a gas and, condense and solidify into particulate material at exhaust conditions. Thus, to the extent possible, it may be desirable and preferred that the alkali metal nitrate content of the subject compositions be reduced or minimized to the extent possible.

The primary fuel component of the subject igniter compositions is an alloy of aluminum and magnesium (herein sometimes referred to as an "Al/Mg alloy"). In particular, an Al/Mg alloy which contains about 50 to about 80 wt % Al and about 20 to about 50 wt % Mg, preferably about 65–75 wt % Al and about 25–35 wt % Mg, has been found to provide or result in a desirably ignitable composition which is also generally resistant to reaction with water at process conditions including temperature. In particular, though aluminum is generally less reactive with water, it can, at least at times, be difficult to ignite. On the other hand, though magnesium is generally very reactive and thus typically more easily ignited, magnesium is typically also much more reactive with water and can thus make processing, particularly water processing, difficult or undoable. In the practice of the invention, the use of the Al/Mg alloy has been found to provide or result in a composition which is more ignitable than a similar composition but without the inclusion of magnesium. Also, the use of the Al/Mg alloy has been found to provide or result in a composition which is less reactive or more resistant to reaction with water as compared to a similar composition but without the inclusion of aluminum.

In addition to being generally resistant to hydrolysis reaction, such an Al/Mg alloy has been found, upon combustion, to desirably produce or form magnesium aluminate combustion products which have relatively high melting points and which can thus more easily be filtered or otherwise removed from the gaseous effluent which is subsequently passed into an associated airbag cushion.

As identified above, the subject igniter compositions desirably contain a gas-producing fuel component. In practice, the igniter compositions of the invention generally include about 1 to about 20 wt % of such a gas-producing fuel component.

It has been found that increasing the pressure within the combustion chamber wherein the gas generant material of an inflator is burned can reduce the delay until first pressure within an associated airbag cushion as well as lead to a more rapid combustion of the gas generant. The inclusion of a gas-producing fuel component within the subject igniter compositions, in accordance with the invention, provides a relatively simple means by which the pressure within the combustion chamber can desirably be increased in association with the firing of the ignition composition.

Various gas-producing fuel component materials, such as known to those skilled in the art can be used. Desirably, such gas-producing fuel component can be selected from the group consisting of organic polymer binders, high energy nitro compounds, nitrate ester, guanidine nitrate, nitroamine compounds and mixtures thereof.

High energy nitro compounds useful in the practice of the invention may typically include organic compounds with one or more covalently bound nitro groups. Tetranitrocarbazole, trinitrotoluene, picric acid and nitroguanidine are particular examples of nitro compounds which may, if desired, be used in the practice of the invention.

Examples of nitrate esters which may be used in the practice of the invention include nitrocellulose and nitroglycerin.

Nitroamine compounds which may be used in the practice of the invention may include nitro-based amines such as cyclotrimethylenetrinitramine (RDX) and cyclotetramethylene tetranitramine (HMX), for example.

Particularly preferred gas-producing fuel component materials for use in the practice of the invention are water-soluble organic polymer binders such as polyacrylamide, polyacrylic acid and combinations thereof. As will be appreciated, the inclusion of such water-soluble binder materials can facilitate water processing and handling of the subject inventive igniter compositions.

If desired, the subject inventive igniter compositions may additionally include, boron or other metallic co-fuel component, such as to improve the ignitability of the composition. Generally, if included, such boron or other metallic co-fuel component is present in a relative amount of no more than about 10 wt % of the igniter composition. Metallic co-fuel materials useful in the practice of the invention include: metal elements such as Zr, Ti, and Si; and related hydrides such as $TiH_2$, and $ZrH_2$. Such boron or other metallic co-fuel component may take the form of such elements, related hydrides as well as mixtures thereof.

The reduced particulate igniter compositions of the invention desirably produce combustion products wherein no more than about 50 mass percent and, preferably, no more than about 25 mass percent, of the condensible combustion products melt at a temperature of less than about 2750 K. This is to be contrasted with igniter compositions such as standard $BKNO_3$ which typically can result or produce condensible combustion products of which about 60 to about 80 mass percent or more have a melt at a temperature of less than about 2750 K.

In practice, igniter compositions such as used in association with a inflatable restraint systems can readily be distinguished from the associated gas generant materials on various basis including combustion flame temperature. For example, the igniter compositions of the invention generally have a combustion flame temperature of at least about 2750 K and generally in the range of about 2750 to about 4500 K. In contrast, conventional gas generant materials commonly have a combustion flame temperature in the range of about 1000 to about 2200 K.

As compared to solvent-based processing, water processible igniter compositions can advantageously avoid the complications such as those associated with solvent recovery or recycle. Thus, water processible igniter compositions in accordance with the invention can provide improved or simplified processibility such as may correspondingly reduce the costs associated with the processing thereof.

Thus, another aspect of the subject invention provides an improved method of processing an igniter composition for a gas generant material. In one method of processing an igniter composition for a gas generant material in accordance with the invention, the igniter composition ingredients, such as described above, are mixed with about 10 to about 20 weight percent water.

Such mixing can be accomplished by various means as are known to those skilled in the art. For example, if desired, such mixing can be done in a Hobart mixer using planetary type mixing blades. Typically, such mixing is continued to produce or form an igniter composition precursor having a stiff, dough-like consistency.

This precursor is then desirably sized and dried to form the subject composition into a granular form having a selected particle size. For example, such sizing and drying can be simply accomplished by first passing the material through screen, typically about 14 to about 20 mesh screen (corresponding to particle size of about 1400 to about 850 microns). The initially sized material can then be finally dried to remove remaining moisture and classified such as by means of screens to remove fines and dust. For example, the finally dried material can be processed through 100 mesh screens such that fines and dust smaller than about 150 microns pass through the screen and are recycled or appropriately discarded or alternatively used. The desired material, such as saved on the screen, can then be appropriately packaged for subsequent use.

A particularly preferred water processible igniter composition in accordance with the invention includes about 50 to about 75 percent of an oxidizer comprising strontium nitrate, about 0.5 to about 35 percent of an Al/Mg alloy fuel component and about 1 to about 20 percent of a gas-producing fuel component comprising a water-soluble organic polymer binder.

In particular, the invention provides a method for water processing a magnesium-containing igniter composition and which method has been found to unexpectedly avoid performance damaging reaction of magnesium with water.

As will be appreciated, igniter compositions in accordance with the invention can be incorporated, utilized or practiced in conjunction with a variety of different structures, assemblies and systems. As representative, the FIGURE illustrates a vehicle 10 having an interior 12 wherein is positioned an inflatable vehicle occupant safety restraint system, generally designated by the reference numeral 14. As will be appreciated, certain standard elements not necessary for an understanding of the invention may have been omitted or removed from the FIGURE for purposes of facilitating illustration and comprehension.

The vehicle occupant safety restraint system 14 includes an open-mouthed reaction canister 16 which forms a housing for an inflatable vehicle occupant restraint 20, e.g., an inflatable airbag cushion, and an apparatus, generally designated by the reference numeral 22, for generating or supplying inflation gas for the inflation of an associated occupant restraint. As identified above, such a gas generating device is commonly referred to as an "inflator."

The inflator 22 contains a quantity of an igniter composition in accordance with the invention such as to facilitate and permit the desired rapid ignition of an associated gas generant material such as also contained therewithin. To that end, the gas generating device desirably contains the igniter composition in ignition communication with the gas generant material, such as is known in the art. As will be appreciated, the specific construction of the inflator device does not form a limitation on the broader practice of the invention and such inflator devices can be variously constructed such as is also known in the art.

In practice, the airbag cushion 20 upon deployment desirably provides for the protection of a vehicle occupant 24 by restraining movement of the occupant in a direction toward the front of the vehicle, i.e., in the direction toward the right as viewed in the FIGURE.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

For each of Examples 1–5, the various igniter compositions in accordance with the invention and shown in TABLE 1 below (component values in terms of "wt %") were prepared and evaluated in a standard driver side inflator hardware, with at least two runs made with each igniter composition. In each case, the mass of the respective igniter composition as well as the gas generant material and the load thereof were the same.

In each run, the inflator was bolted to a 60-liter deployment tank and deployed. All the gases which exited from the inflator were captured in the associated deployment tank.

After deployment, the inside of the tank was washed with water and the wash water was collected in a beaker of known weight. The wash water was then evaporated and the beaker was weighed, with this weight compared to the known weight of the beaker. The difference in these weights is reported in TABLE 2, below, as particulate (resid) weight.

TABLE 1

IGNITER COMPOSITIONS

| | | Al/Mg alloy | | Gas-Producing Fuel Component | | | |
|---|---|---|---|---|---|---|---|
| Example | $SrNO_3$ | 50/50 | 70/30 | A | B | C | Zr |
| 1 | 71.70 | 12.30 | — | 5.00 | 5.00 | — | 6.00 |
| 2 | 74.50 | 20.50 | — | — | 5.00 | — | — |
| 3 | 63.28 | 26.72 | — | — | — | 10.00 | — |
| 4 | 69.14 | — | 12.86 | 5.00 | 5.00 | — | 8.00 |
| 5 | 72.17 | — | 22.83 | — | 5.00 | — | — |

where:

Examples 1–3 employed an Al/Mg alloy having an Al content of 50 percent and a Mg content of 50 percent;

Examples 4 and 5 employed an Al/Mg alloy having an Al content of 70 percent and a Mg content of 30 percent;

A=tetranitrocarbazole;
B=polyacrylamide, and
C=nitroguanidine.

TABLE 2

| | Resid Weight (mg) | |
|---|---|---|
| Example | Avg. | Stnd. Dev. |
| 1 | 0.12 | 0.02 |
| 2 | 0.14 | 0.04 |
| 3 | 0.10 | 0.03 |
| 4 | 0.16 | 0.11 |
| 5 | 0.19 | 0.10 |

Discussion of Results

As demonstrated by the results obtained in Examples 1–5 and shown in TABLE 2, above, igniter compositions in accordance with the invention produced, formed or resulted in reside weights of about 0.10 to about 0.19. Thus, as compared to standard $BKNO_3$ igniter formulation, as identified above and which has been found under similar operation and conditions to produce, form or result in resid weights of about 0.5 mg, the subject igniter compositions dramatically reduce the amount of particulate material that issues forth from associated inflator devices upon the actuation thereof.

Thus, the invention provides an igniter material which is desirably improved in one or more aspects such as safety, simplicity, effectiveness, economy and reliability. Further, the invention provides an igniter formulation such as may further reduce either or both the amount or concentration of particulate material that may issue forth from associated inflator devices upon the actuation thereof. Still further, the invention provides igniter formulations which reduce, minimize or possibly avoid the need for relatively costly igniter composition components such as boron. Yet still further, the invention provides water processible igniter compositions and associated processing methods such as may improve or simplify processing such as complications relating to solvent recovery or recycle in processing using a non-water solvent. Yet still even further, the invention provides a method for water processing a magnesium-containing igniter composition and which method has been found to unexpectedly avoid performance damaging reaction of magnesium with water.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. An igniter composition comprising:

about 50 to about 75 composition weight percent of an oxidizer comprising strontium nitrate;

about 0.5 to about 35 composition weight percent of an Al/Mg alloy fuel component, said Al/Mg alloy fuel component having an Al content of about 50 to about 80 percent and a Mg content of about 50 to about 20 percent; and about 1 to about 20 composition weight percent of a gas-producing fuel component.

2. The igniter composition of claim 1 wherein said oxidizer additionally comprises an alkali metal nitrate.

3. The igniter composition of claim 2 wherein no more than about 50 percent of said oxidizer is an alkali metal nitrate.

4. The igniter composition of claim 2 wherein the alkali metal nitrate is potassium nitrate.

5. The igniter composition of claim 1 wherein said Al/Mg alloy fuel component has an Al content of about 70 percent and a Mg content of about 30 percent.

6. The igniter composition of claim 1 wherein said gas-producing fuel component is selected from the group consisting of organic polymer binders, high energy nitro compounds, nitrate ester, guanidine nitrate, nitroamine compounds and mixtures thereof.

7. The igniter composition of claim 1 wherein said gas-producing fuel component is a water-soluble organic polymer binder.

8. The igniter composition of claim 7 wherein the water-soluble organic polymer binder is selected from the group consisting of polyacrylamide, polyacrylic acid and combinations thereof.

9. The igniter composition of claim 1 wherein no more than about 50 mass percent of the condensible combustion products melt at a temperature of less than about 2750 K.

10. The igniter composition of claim 9 additionally comprising up to about 10 composition weight percent of boron.

11. The igniter composition of claim 9 wherein no more than about 25 mass percent of the condensible combustion products melt at a temperature of less than about 2750 K.

12. The igniter composition of claim 11 additionally comprising up to about 10 composition weight percent of a metallic co-fuel selected from the group consisting of Zr, Ti, $TiH_2$, Si, $ZrH_2$ and mixtures thereof.

13. The igniter composition of claim 1 wherein said Al/Mg alloy fuel component has an Al content of about 70 to about 80 percent and a Mg content of about 30 to 20 percent, said igniter composition additionally comprising up to about 10 percent of boron, a metallic co-fuel selected from the group consisting of Zr, Ti, $TiH_2$, Si, $ZrH_2$ and mixtures thereof.

14. The igniter composition of claim 1 having a combustion flame temperature of at least about 2750 K.

15. A gas generating device containing the igniter composition of claim 1 in ignition communication with a gas generant material.

16. An inflatable vehicle occupant safety restraint system EA comprising:

the gas generating device of claim 15 connected in association with an inflatable airbag cushion for inflating the airbag cushion.

17. A reduced particulate igniter composition for a gas generant material, said igniter composition comprising:

about 50 to about 75 composition weight percent of an oxidizer comprising strontium nitrate and potassium nitrate, wherein no more than about 50 mass percent of the oxidizer is potassium nitrate;

about 0.5 to about 35 composition weight percent of an Al/Mg alloy fuel component having an Al content of about 50 to about 80 percent and a Mg content of about 50 to 20 percent; and about 1 to about 20 composition weight percent of a gas-producing water-soluble organic polymer binder fuel component, said igniter composition having a combustion flame temperature of at least about 2750 K and, upon combustion, said igniter composition produces combustion products including condensible combustion products and wherein no more than about 50 mass percent of the condensible combustion products melt at a temperature of less than about 2750 K.

18. The igniter composition of claim 17 wherein no more than about 25 mass percent of the condensible combustion products melt at a temperature of less than about 2750 K.

19. The igniter composition of claim 17 additionally comprising up to about 10 composition weight percent of a metallic co-fuel selected from the group consisting of Zr, Ti, $TiH_2$, Si, $ZrH_2$ and mixtures thereof.

20. A method of processing an igniter composition for a gas generant material, said method comprising the steps of:

admixing about 10 to about 20 weight percent water to an igniter composition precursor mix containing, on a water free basis, about 50 to about 75 percent of an oxidizer comprising strontium nitrate, about 0.5 to about 35 percent of an Al/Mg alloy fuel component and about 1 to about 20 percent of a gas-producing fuel component comprising a water-soluble organic polymer binder to form a moisture-containing igniter precursor mass; and sizing and drying the moisture-containing igniter precursor mass to form a granular igniter material of selected particle size.

21. The method of claim 20 wherein the water-soluble organic polymer binder is selected from the group consisting of polyacrylamide, polyacrylic acid and combinations thereof.

* * * * *